US007989075B2

(12) United States Patent
Jin et al.

(10) Patent No.: US 7,989,075 B2
(45) Date of Patent: Aug. 2, 2011

(54) CHROME-FREE COMPOSITION OF LOW TEMPERATURE CURING FOR TREATING A METAL SURFACE AND A METAL SHEET USING THE SAME

(75) Inventors: Yeong-Sool Jin, Pohang (KR); Sung-Mun Keom, Seoul (KR); Jin-Tae Kim, Pohang (KR)

(73) Assignees: POSCO (KR); Daehan Parkerizing Co., Ltd. (KR)

( * ) Notice: Subject to any disclaimer, the term of this patent is extended or adjusted under 35 U.S.C. 154(b) by 819 days.

(21) Appl. No.: 11/993,096

(22) PCT Filed: Jun. 20, 2006

(86) PCT No.: PCT/KR2006/002346

§ 371 (c)(1),
(2), (4) Date: Dec. 19, 2007

(87) PCT Pub. No.: WO2006/137663

PCT Pub. Date: Dec. 28, 2006

(65) Prior Publication Data

US 2010/0273013 A1 Oct. 28, 2010

(30) Foreign Application Priority Data

Jun. 20, 2005 (KR) ..... 10-2005-0052848

(51) Int. Cl.
*B32B 9/06* (2006.01)
*C04B 9/02* (2006.01)
*C09K 3/00* (2006.01)

(52) U.S. Cl. ..... 428/450; 106/14.05; 106/14.11; 106/14.21; 106/14.12; 106/14.14; 252/388; 252/389.1; 252/389.3; 252/389.54; 252/389.61

(58) Field of Classification Search ..... 106/14.05, 106/14.11, 14.21, 14.12, 14.14; 428/450; 252/388, 389.1, 389.3, 389.54, 389.61
See application file for complete search history.

(56) References Cited

U.S. PATENT DOCUMENTS

| | | | |
|---|---|---|---|
| 5,721,056 | A | 2/1998 | Wessling |
| 5,969,019 | A | 10/1999 | Kanai et al. |
| 6,040,054 | A | 3/2000 | Odashima et al. |
| 6,475,300 | B2 | 11/2002 | Shimakura et al. |
| 6,514,357 | B1 | 2/2003 | Tada et al. |
| 6,736,908 | B2 | 5/2004 | Sako et al. |
| 2005/0037208 | A1 | 2/2005 | Ogino et al. |

FOREIGN PATENT DOCUMENTS

| | | | |
|---|---|---|---|
| EP | 0787830 | A2 | 8/1997 |
| EP | 1002889 | A2 | 5/2000 |
| EP | 1146144 | A1 | 10/2001 |
| JP | 8500770 | A | 1/1996 |
| JP | 8092479 | A | 4/1996 |
| JP | 09241587 | A | 9/1997 |
| JP | 10060315 | A | 3/1998 |
| JP | 11029724 | A | 2/1999 |
| JP | 2000144020 | A | 5/2000 |
| JP | 2001181860 | A | 7/2001 |
| JP | 2003201579 | A | 7/2003 |
| JP | 2004183015 | A | 7/2004 |
| JP | 2005120469 | A | 5/2005 |
| WO | 0107680 | A1 | 2/2001 |
| WO | 2004005579 | A1 | 1/2004 |

*Primary Examiner* — Kevin R. Kruer
(74) *Attorney, Agent, or Firm* — The Webb Law Firm

(57) ABSTRACT

Provided is a chromium-free, low-temperature curable, metal-surface treatment composition comprising 5 to 30 parts by weight of a silane compound having an epoxy group and a silane compound having an amino group or a hydrolytic condensate thereof; 0.1 to 5 parts by weight of a vanadium compound; 0.1 to 5 parts by weight of a magnesium compound; 1 to 10 parts by weight of organic/inorganic acids; 0.05 to 2 parts by weight of a crosslinking accelerating and coupling agent; 0.01 to 1 part by weight of an antifoaming agent; 1 to 2 parts by weight of a wetting agent; and the balance of water and ethanol, based on 100 parts by weight of the total solution. In addition, a steel sheet coated with the above-described metal-surface treatment composition is low-temperature curable and provides anticorrosiveness while containing no chromium components.

13 Claims, No Drawings

CHROME-FREE COMPOSITION OF LOW TEMPERATURE CURING FOR TREATING A METAL SURFACE AND A METAL SHEET USING THE SAME

This application is a nation stage of PCT application No. PCT/KP2006/002346, filed Jun. 20, 2006, which in turn claims priority from Korean Application 10-2005-0052848, filed Jun. 20, 2005.

TECHNICAL FIELD

The present invention relates to a chromium-free, metal-surface treatment composition and a surface-treated steel sheet using the same. More specifically, the present invention relates to an ultra-thin film forming, metal-surface treatment composition which is low-temperature curable and contains no chromium components, thereby being capable of securing corrosion resistance of a steel sheet, and a surface-treated steel sheet using the same.

BACKGROUND ART

Recently, a great deal of attention has been directed to environmental concerns throughout the world, and therefore many countries have strictly strengthened regulations on use of environmental contaminants, e.g. heavy metals such as chromium (Cr), lead (Pb), cadmium (Cd) and mercury (Hg), polybrominated biphenyl (PBB), polybrominated diphenyl ether (PBDE) and the like. Specifically, typical examples of such environmental legislations include RoHS (Restriction of Hazardous Substances, effective from Jul. 1, 2006), WEEE (Waste from Electrical and Electronic Equipment, effective from Jul. 1, 2006), ELV (End-of-Life Vehicles, effective from Jan. 1, 2007) and REACH (Registration, Evaluation and Authorization of Chemicals), which were adopted by the European Union (EU). In order to cope with the trends of these restrictions on the use of such hazardous substances, there are required active countermeasures against new environmental management policies, such as development of environmentally friendly products, reduction of industrial wastes which might be generated from factories and plants, introduction of a green procurement policy and the like.

Conventionally, in order to impart corrosion resistance and coating adhesion to zinc- and zinc alloy-coated steel sheets, aluminum- and aluminum alloy-coated steel sheets, cold-rolled steel sheets and hot-rolled steel sheets which have been widely used as automotive materials, building materials and materials for household electric appliances, a surface treatment is generally conducted which involves coating of metal surfaces with a chromate film that is composed mainly of chromium as a principal component. Chromate treatments may be broadly divided into electrolytic chromating and application chromating. In this connection, the electrolytic chromating is usually performed by cathodic electrolysis of a metal sheet using a treatment solution which contains hexavalent chromium (Cr (VI)) as a main ingredient and also contains a variety of added anions such as sulfate, phosphate, borate, and halogens. On the other hand, application chromating involves preparation of a treatment solution by adding an inorganic colloid or inorganic anion to a solution with a portion of the hexavalent chromium portion reduced to trivalent chromium beforehand and immersing the metal sheet therein or spraying the metal sheet with the treatment solution.

Unfortunately, use of these methods requires various measures associated with working conditions and drainage treatment, due to toxicity of hexavalent chromium contained in the chromating solution. In addition, recycling and waste disposal of automobiles, household electric appliances and building materials, which use the thus surface-treated metal sheets, also suffer from problems of harmfulness to human and environmental pollution.

To this end, the world's steel makers have focused efforts on the development of chromium-free, surface-treated steel sheets which can meet a variety of required characteristics such as corrosion resistance and conductivity, even without containing hexavalent chromium. According to conventional arts, chromium-free, surface-treated steel sheets have been manufactured via a method involving primary coating of a metal salt film, which is primarily composed of phosphate as a principal component, on the surface of the steel sheet, followed by secondary coating of a resin film which is primarily composed of acrylic and urethane resins as a main component, or a method involving formation of resin films as the primary and secondary films.

Further, numerous methods have been hitherto proposed for the development of surface treating agents such as chromium-free, anticorrosive metal coating agents. For example, Japanese Patent Laid-open Publication No. Hei 11-29724 discloses a chromium-free, anti-rusting agent comprising a thiocarbonyl group-containing compound and phosphate ions, and further water-dispersible silica in a waterborne resin. This system exhibits corrosion resistance comparable to a level of corrosion resistance imparted by chromating treatment, but disadvantageously suffers from insufficient storage stability and also poor corrosion resistance performance of the thin film.

In addition, Japanese Patent Laid-open Publication No. Hei 10-60315 discloses a surface treating agent for steel structures, comprising a silane coupling agent having a specific functional group which is reactive with a water-based emulsion. However, corrosion resistance required in this Japanese Patent is for relatively mild test conditions such as in wet testing and is not comparable to that of the present invention which withstands severe conditions such as a salt spray test on the thin film, as performed in the present invention.

Additionally, as a coating method which is designed in consideration of conductivity while involving no use of conventional hexavalent chromium, methods of coating a metal sheet with polyaniline are disclosed in Japanese Patent Laid-open Publication Nos. Hei 8-92479 and Hei 8-500770. However, due to the presence of polyaniline having high rigidity and low adhesion between the metal and resin film, peeling of the resulting film can easily occur at polyaniline-metal interfaces and polyaniline-resin interfaces. Such a probability of peeling poses problems when it is desired to perform coating on the top part of the steel sheet, in order to impart designability, particularly anticorrosiveness and other functions. Films with low adhesion are generally known to have low corrosion resistance. In addition, use of polyaniline also results in poor workability such as production of large amounts of precipitates due to low solution stability, worsening of working conditions due to generation of poisonous odor, and the like. Furthermore, such polyaniline-based solution compositions require high-temperature drying and curing conditions.

Therefore, the present invention has been made in view of the above problems, and it is an object of the present invention to provide a surface treatment composition for a steel sheet which is post-treated with a chromium-free composition, particularly an inorganic, aqueous, metal-surface treatment composition which is capable of securing corrosion resistance and electrical conductivity and is curable at a low temperature.

It is another object of the present invention to provide a steel sheet which is surface-treated by coating with the above-mentioned metal-surface treatment composition.

SUMMARY OF THE INVENTION

In accordance with an aspect of the present invention, the above and other objects can be accomplished by the provision of a chromium-free, low-temperature curable, metal-surface treatment composition comprising 5 to 30 parts by weight of a silane compound having an epoxy group and a silane compound having an amino group or a hydrolytic condensate thereof; 0.1 to 5 parts by weight of a vanadium compound; 0.1 to 5 parts by weight of a magnesium compound; 1 to 10 parts by weight of organic/inorganic acids; 0.05 to 2 parts by weight of a crosslinking accelerating and coupling agent; 0.01 to 1 part by weight of an antifoaming agent; 1 to 2 parts by weight of a wetting agent; and the balance of water and ethanol, based on 100 parts by weight of the total solution.

In accordance with another aspect of the present invention, there is provided a steel sheet coated with the above chromium-free, low-temperature curable, metal-surface treatment composition.

BEST MODE FOR CARRYING OUT THE INVENTION

Hereinafter, the present invention will be described in more detail.

Preparation of a chromium-free, metal-surface treatment composition of the present invention employs a silane compound and/or a hydrolytic condensate thereof. As used herein, the term "hydrolytic condensate of a silane compound" refers to an oligomer of a silane compound which is obtained by hydrolytic polymerization of the silane compound as a raw material.

The amount of the silane compound used in the composition of the present invention is in a range of 5 to 30 parts by weight, preferably 5 to 20 parts by weight, based on 100 parts by weight of the total solution. If the amount of the silane compound is less than 5 parts by weight, it is difficult to obtain sufficient improvement in corrosion resistance and adhesion. Conversely, if the amount of the silane compound exceeds 30 parts by weight, storage stability is undesirably decreased.

In particular, the present invention involves combined use of (a) a silane compound having an amino group and (b) a silane compound having at least one epoxy group, wherein a mixing ratio of compounds (a):(b) is preferably in a range of 5-10:15-20, more preferably in a range of 7:13.

The silane compound, which may be used in the chromium-free, metal-surface treatment composition according to the present invention, is not particularly limited and preferably includes, for example vinylmethoxysilane, vinyltrimethoxysilane, vinylepoxysilane, vinyltriepoxysilane, 3-aminopropyltriepoxysilane, 3-glycidoxypropyltrimethoxysilane, 3-metaglycidoxypropyltrimethoxysilane, 3-mercaptopropyltrimethoxysilane, N-(1,3-dimethylbutylidene)-3-(triepoxysilane)-1-propaneamine, N,N-bis[3-(trimethoxysilyl)propyl]ethylenediamine, N-(β-aminoethyl)-γaminopropylmethyldimethoxysilane, N-(β-aminoethyl)-γaminopropyltrimethoxysilane, γ-glycidoxypropyltriethoxysilane, γ-glycidoxytrimethyldimethoxysilane, 2-(3,4-epoxycyclohexyl)ethyltrimethoxysilane, γ-methacryloxypropyltrimethoxysilane, γ-methacryloxypropyltriethoxysilane, γ-mercaptopropyltrimethoxysilane, γ-mercaptopropyltriethoxysilane, and N-[2-(vinylbenzylamino)ethyl]-3-aminopropyltrimethoxysilane.

Amounts of a vanadium compound and a magnesium compound, which are added to the composition of the present invention, are respectively in a range of 0.1 to 5 parts by weight. If each metal compound is added in an amount of less than 0.1 parts by weight, it is difficult to form a metal chelate compound. Conversely, if each compound is added in an amount of more than 5 parts by weight, physical properties of the resulting solution are deteriorated due to the presence of the remaining unreacted metal compounds. Preferably, the vanadium compound is added in an amount of 0.5 parts by weight and the magnesium compound is added in an amount of 2.0 parts by weight.

Preferably, the vanadium compound, which is contained in the metal-surface treatment composition of the present invention, is a vanadium compound having a vanadium oxidation number of 2 to 5 and includes, for example vanadium pentoxide ($V_2O_5$), vanadium trioxide ($V_2O_3$), vanadium dioxide ($VO_2$), vanadium oxyacetylacetonate, vanadium acetylacetonate, vanadium trichloride ($VCl_3$), vanadium monoxide ($V_O$), and ammonium metavanadate ($NH_4VO_3$). Preferably, examples of the magnesium-containing compound include oxides, hydroxides, complex compounds and salt compounds of magnesium, such as magnesium sulfate, magnesium nitrate and magnesium oxide.

Further, the organic/inorganic acids, which are used in the metal-surface treatment composition of the present invention, can make a contribution to improvement in adhesion of the film. Preferred examples of acids that are utilizable in the present invention may include inorganic acids such as phosphoric acid, and organic acids such as formic acid and ethylenediamine tetraacetic acid. Contents of organic/inorganic acids are preferably in a range of 1 to 10 parts by weight. If organic/inorganic acids are added in amounts of less than 1 part by weight, it is vulnerable to etching of metal materials. Conversely, if organic/inorganic acids are added in amounts of more than 10 parts by weight, this is undesirable for stability of the solution and physical properties of the film.

Further, in order to accelerate a curing process and maintain firmness of the film, the composition may also contain titanium and zirconium compounds as a crosslinking accelerating and coupling agent of the silane condensation reaction product. The titanium compound that can be used in the present invention is preferably at least one compound selected from the group consisting of diisopropyl ditriethanolamino titanate, titanium lactate chelate and titanium acetylacetonate. In addition, the zirconium compound that can be used in the present invention is preferably selected from zirconyl nitrate, zirconyl acetate, ammonium zirconyl carbonate and zirconium acetylacetonate. Herein, the amount of the crosslinking accelerating and coupling agent is limited to within a range of 0.05 to 2 parts by weight. If the agent is added in an amount of less than 0.05 parts by weight, it is difficult to achieve desired corrosion resistance of the film. On the other hand, if the amount of the added agent is higher than 2 parts by weight, this may lead to deterioration in storage stability and physical properties of the film.

In order to prevent the formation of foams in the solution, N-methylethanolamine as an antifoaming agent is added in an amount of 0.01 to 1 part by weight. If the content of the antifoaming agent added is less than 0.01 parts by weight, sufficient antifoaming effects are not exerted. On the other hand, if the content of the antifoaming agent is higher than 1 part by weight, this may result in decreased corrosion resistance.

Additionally, isopropyl alcohol as a wetting agent may be added to improve wettability of the solution. The content of the added wetting agent is limited to within a range of 1 to 2 parts by weight. If the wetting agent is added in an amount of less than 1 part by weight, this leads to no improvement in wettability of the solution. Addition of the wetting agent exceeding 2 parts by weight does not result in deterioration of physical properties, but this also leads to no improvement in wettability of the solution, thus being economically undesirable.

Finally, as the remaining other components necessary for preparation of the composition of the present invention, 60 to 80 parts by weight of water and 10 to 20 parts by weight of ethanol for fast drying may be added. The contents of pure water and ethanol are not particularly limited and may be therefore used in conventional amounts depending upon the desired level of solids.

Hereinafter, a steel sheet will be described which is coated with a chromium-free, metal-surface treatment composition according to the present invention.

Coating of the steel sheet with the chromium-free, metal-surface treatment composition according to the present invention is carried out by applying the treatment solution to a surface of a metal material such that a coating amount of a dry film is in a range of 0.05 to 1.0 g/m$^2$, more preferably 0.1 to 0.5 g/m$^2$, followed by drying of the resulting film for 0.1 to 30 sec.

In the present invention, a pH value of an aqueous composition relative to a coating layer is preferably adjusted to within a range of 3.0 to 7.0, using organic/inorganic acids as described hereinbefore. More preferably, the pH of the composition is adjusted to within a range of 3.5 to 5.0. If the pH value of the composition is less than 3.0, over-etching of the material surface by the treatment solution results in insufficient corrosion resistance. Conversely, if the pH value is higher than 7.0, this may result in gelation or precipitation of the treatment solution due to decreased stability thereof.

According to the present invention, a heating temperature after treatment of the material surface with the treatment solution is preferably set to PMT (Peak metal temperature) ranging from 30 to 250° C., and application methods are not particularly limited. As conventional methods that can be used in the present invention and are known in the art, mention may be made of a roll coating method involving roll transfer of a coating solution to the material surface, a method involving spraying a coating solution to the material surface using proper equipment such as a sprayer and spreading the treating agent via the roll, and a method of dipping a material of interest in a treatment solution.

In addition, although pre-treatment processes are also not specifically defined, oily residues and stain spots, which are adhered to or present on a material to be treated, may be removed by cleaning the material with alkaline or acidic degreasing agents, or subjecting the material to hot-water cleaning or solvent cleaning, usually prior to application of a coating. Thereafter, if necessary, surface conditioning is carried out using acid or alkali. Upon cleaning of the material surface, it is preferred to wash the material with water after surface cleaning thereof, such that as little detergent as possible remains on the surface of the material. Although the treatment solution of the present invention may be directly applied to the metal material following surface cleaning thereof, it is also possible to apply the treatment solution after phosphate conversion coating.

EXAMPLES

Now, the present invention will be described in more detail with reference to the following examples. These examples are provided only for illustrating the present invention and should not be construed as limiting the scope and spirit of the present invention.

Examples 1 Through 8 and Comparative Examples 1 Through 7

1. Metal Materials Used in Examples and Comparative Examples

Commercially available hot-dip galvanized steel (HGI) was used as the metal material.

2. Preparation of Treatment Solutions

The treatment solution of the present invention was prepared as follows. First, based on 100 parts by weight of the total solution, 5 to 20 parts by weight of 3-glycidoxypropyltrimethoxysilane as an epoxysilane compound and 3-aminopropyltriethoxysilane as an aminosilane compound were added and hydrolyzed in a mixture of 60 parts by weight of pure water and 10 parts by weight of ethanol. Then, as metal compounds, 0.1 to 5 parts by weight of vanadium acetylacetonate and 0.1 to 5 parts by weight of magnesium oxide were respectively dissolved in 1 to 10 parts by weight of an organic acid and phosphoric acid, and the resulting solution was added to the above-obtained solution of silane compounds, which was then stirred for 30 min. Finally, 0.05 to 2 parts by weight of diisopropyl ditriethanolamino titanate and, as other additives, 0.01 to 1 part by weight of N-methylethanolamine as an antifoaming agent and 1 to 2 parts by weight of isopropyl alcohol as a wetting agent were added thereto and the resulting mixture was stirred at 1,000 rpm and room temperature for 30 min, thereby preparing a treatment solution.

Composition formulae for treatment solutions of Examples 1 through 8 and Comparative Examples 1 through 7 are given in Tables 1 and 2 below, respectively. The composition as set forth in Table 1 was expressed based on 100 parts by weight of the total solution. The remaining components other than additives listed in Table 1 are pure water and ethanol.

TABLE 1

Compositions of Examples 1 through 8

| Example No. | Resin | Silane compounds | Silica | Metal compounds | Etchants | Coupling agents | Curing temp. (° C.) |
|---|---|---|---|---|---|---|---|
| 1 | — | eposysilane(13) aminosilane (7) | — | vanaduim (0.5)magnesium (2) | $H_3PO_4$(3)HCOOH(3) | titanium compound (2) | 60 |
| 2 | — | eposysilane(13) aminosilane (7) | — | vanaduim (0.5)magnesium (2) | $H_3PO_4$(3)HCOOH(3) | titanium compound (0.5) | 60 |

TABLE 1-continued

Compositions of Examples 1 through 8

| Example No. | Resin | Silane compounds | Silica | Metal compounds | Etchants | Coupling agents | Curing temp. (° C.) |
|---|---|---|---|---|---|---|---|
| 3 | — | eposysilane(13) aminosilane (7) | — | vanaduim (0.5)magnesium (2) | $H_3PO_4$(3)HCOOH(3) | titanium compound (0.4) | 60 |
| 4 | — | eposysilane(13) aminosilane (7) | — | vanaduim (0.5)magnesium (2) | $H_3PO_4$(3)HCOOH(3) | titanium compound (0.3) | 60 |
| 5 | — | eposysilane(10) aminosilane (3) | — | vanaduim (1)magnesium (4) | HCOOH(1) EDTA(1) | titanium compound (0.5) | 60 |
| 6 | — | eposysilane(5) aminosilane (2) | — | vanaduim (2)magnesium (3) | HCOOH(0.5) EDTA(0.5) | titanium compound (0.1) | 60 |
| 7 | — | eposysilane(13) aminosilane (7) | — | vanaduim (0.5)magnesium (2) | $H_3PO_4$(3)HCOOH(3) | zircomium compound (2) | 60 |
| 8 | — | eposysilane(13) aminosilane (7) | — | vanaduim (0.5)magnesium (2) | $H_3PO_4$(3)HCOOH(3) | zircomium compound (0.5) | 60 |

*EDTA: Ethylene diamine tetraacetic acid

TABLE 2

Compositions of Comparative Examples 1 through 7

| Comp. Example No. | Resin | Silanecompounds | Silica | Metal compounds | Etchants | Coupling agents | Curing temp. (° C.) |
|---|---|---|---|---|---|---|---|
| 1 | — | epoxysilane (20)aminosilane (15) | — | vanadium(1) magnesium (3) | $H_3PO_4$(3) HCOOH (3) | titanium compound (2) | 60 |
| 2 | — | epoxysilane (13)aminosilane (7) | — | vanadium(0.5) magnesium (2) | Oxalic acid(3) | titanium compound (0.5) | 60 |
| 3 | — | epoxysilane (13)aminosilane (7) | — | vanadium(0.5) magnesium (2) | $H_3PO_4$(3) HCOOH (3) | — | 60 |
| 4 | urethane resin(20) | epoxysilane (12) | — | vanadium(1) | $H_3PO_4$(3) | — | 180 |
| 5 | urethane resin(20) | epoxysilane (3)aminosilane (3) | — | vanadium(0.5) magnesium (1) | $H_3PO_4$(3) | — | 180 |
| 6 | acrylic resin(20) | vinylsilane(5) | 80 | molybdenum (3) | $H_3PO_4$(3) | — | 150 |
| 7 | epoxy resin(30) | epoxysilane (13) | — | vanadium(3) | $H_3PO_4$(3) | titanium compound (0.5) | 150 |

3. Evaluation of Physical Properties

Performance of metal-surface treatment compositions prepared in Examples 1 through 8 and Comparative Examples 1 through 7 was evaluated under the following test conditions. The results thus obtained are given in Table 3 below.

1) Corrosion Resistance

According to a method specified under ASTM B117, corrosion resistance was measured by confirming an incidence rate of white rust in coated steel sheets over time. Evaluation of corrosion resistance was made based on the following criteria.

Excellent: Zero percent white rust-affected area after 24 hours

Good: Less than 5 percent white rust-affected area after 24 hours

Poor: More than 5 percent white rust-affected area after 24 hours

2) Adhesion

According to a method specified under ASTM D3359, adhesion was measured by drawing 11 lines of demarcation vertically and horizontally at 1 mm-intervals on the film, thereby making 100 cells, followed by performing the tape test using a cellophane tape. Evaluation of adhesion was made based on the following criteria.

Excellent: 100 percent retention of film

Good: More than 95 percent retention of film

Poor: Less than 95 percent retention of film

3) Storage Stability

For measuring storage stability, an aqueous inorganic metal-surface treatment composition for anti-rust coating was stored in an incubator at 40° C. for 2 months and observation was made on viscosity increase, gelation and precipitation status of the composition. Evaluation of storage stability was made based on the following criteria.

o: No noticeable changes observed in viscosity increase, gelation and precipitation of the composition x: Noticeable changes observed in viscosity increase, gelation and precipitation of the composition 4) Reactivity to Chromium (Cr)

The solutions prepared in Examples 1 through 8 and Comparative Examples 1 through 7 were respectively mixed with a chromium (Cr) solution in a ratio of 1:1 and the resulting mixtures were stood for 24 hours, followed by examining the state of solutions by naked eyes. Evaluation of reactivity with chromium was made based on the following criteria.

o: No noticeable changes observed in viscosity increase, gelation and precipitation of the composition x: Noticeable changes observed in viscosity increase, gelation and precipitation of the composition

TABLE 3

Results for evaluation of physical properties

| No. | | Corrosion resistance | Adhesion | Storage stability | Cr-reactiveity | Film thickness(□) |
|---|---|---|---|---|---|---|
| Example | 1 | excellent | excellent | ○ | ○ | 0.15 |
| | 2 | excellent | excellent | ○ | ○ | 0.15 |
| | 3 | excellent | excellent | ○ | ○ | 0.15 |
| | 4 | excellent | excellent | ○ | ○ | 0.15 |
| | 5 | excellent | excellent | ○ | ○ | 0.15 |
| | 6 | excellent | excellent | ○ | ○ | 0.15 |
| | 7 | excellent | excellent | ○ | ○ | 0.15 |
| | 8 | good | excellent | ○ | ○ | 0.15 |
| Comp. Example | 1 | poor | good | ○ | ○ | 0.15 |
| | 2 | poor | good | ○ | ○ | 0.15 |
| | 3 | poor | good | ○ | ○ | 0.15 |
| | 4 | poor | excellent | ○ | X(gelation) | 0.15 |
| | 5 | poor | excellent | ○ | X(gelation) | 0.15 |
| | 6 | poor | excellent | ○ | X(gelation) | 0.15 |
| | 7 | poor | excellent | ○ | X(gelation) | 0.15 |

Results of physical property evaluation for respective compositions of Examples and Comparative Examples are set forth in Table 3 above.

As can be seen from Table 3, compositions of Examples 1 through 8 generally secured excellent physical properties, whereas compositions of Comparative Examples 1 through 7 all exhibited poor results in corrosion resistance. Comparative Examples 4 through 7 needs application of a coating film in a practical thickness of more than 0.5 μm in order to secure corrosion resistance, while Examples of the present invention can obtain stable corrosion resistance at a film thickness of more than 0.1 μm. In addition, upon considering current circumstances, since the treatment composition should be produced in conjunction with chromium-containing, surface-treated steel sheets in chromium-free facilities, the treatment composition must not be reactive with chromium. However, compositions of Comparative Examples may result in causes of facility troubles due to occurrence of gelation upon incorporation of the chromium solution.

Further, use of excessive amounts of silane compounds in Comparative Example 1 makes it difficult to secure corrosion resistance, and use of oxalic acid in Comparative Example 2 as a metal etchant also results in failure of acquiring corrosion resistance. Additionally, it is difficult to secure corrosion resistance due to no addition of a titanium compound as a crosslinking accelerating agent in Comparative Example 3.

In addition, compositions of Examples 1 through 6 and Comparative Examples 1 through 3 could obtain desired target values of physical properties due to achievement of drying and curing at a low temperature (60° C.), but compositions of Comparative Examples 4 through 7 could effect curing and drying only when treatment operation is conducted at a high temperature of more than 150° C. If sufficient drying and curing of the film is not effected, it is difficult to secure desired physical properties of the film. Consequently, Examples 1 through 6 of the present invention provide low-temperature curable, highly corrosion-resistant, metal-surface treatment compositions.

A chromium-free, metal-surface treatment composition, which is provided according to the present invention, can be used without modification of the existing chromium treatment facility (for example, a sprayer), imparts excellent anti-corrosiveness and adhesion to a steel sheet after application of a coating solution thereto, and is also low-temperature curable and environmentally friendly due to inclusion of no chromium components.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A chromium-free, low-temperature curable, metal-surface treatment composition comprising: 5 to 30 parts by weight of a silane compound comprising, (a) a silane compound having an epoxy group, and a silane compound having an amino group, or (b) a hydrolytic condensate thereof, or a blend of (a) and (b); 0.1 to 5 parts by weight of a vanadium compound; 0.1 to 5 parts by weight of a magnesium compound; 1 to 10 parts by weight of organic/inorganic acids; 0.05 to 2 parts by weight of a crosslinking accelerating and coupling agent; 0.01 to 1 part by weight of an antifoaming agent; 1 to 2 parts by weight of a wetting agent; and the balance being water and ethanol, based on 100 parts by weight of the total solution.

2. The composition according to claim 1, wherein the silane compound is selected from the group consisting of vinylmethoxysilane, vinyltrimethoxysilane, vinylepoxysilane, vinyltriepoxysilane, 3-aminopropyltriepoxysilane, 3-glycidoxypropyltrimethoxysilane, 3-metaglycidoxypropyltrimethoxysilane, 3-mercaptopropyltrimethoxysilane, N-(1,3-dimethylbutylidene)-3-(triepoxysilane)-1-propaneamine, N,N-bis[3-(trimethoxysilyl)propyl]ethylenediamine, N-(β-aminoethyl)-γ-aminopropylmethyldimethoxysilane, N-(β-aminoethyl)-γ-aminopropyltrimethoxy silane, γ-glycidoxypropyltriethoxysilane, γ-glycidoxytrimethyldimethoxysilane, 2-(3,4-epoxycyclohexyl)ethyltrimethoxysilane, γ-methacryloxypropyltrimethoxysilane, γ-methacryloxypropyltriethoxysilane, γ-mercaptopropyltrimethoxysilane, γ-mercaptopropyltriethoxysilane, and N-[2-(vinylbenzylamino)ethyl]-3-aminopropyltrimethoxysilane.

3. The composition according to claim 1, wherein the organic/inorganic acid is formic acid, ethylenediamine tetraacetic acid or phosphoric acid.

4. The composition according to claim 1, wherein the vanadium compound is a vanadium compound having a vanadium oxidation number of 2 to 5, and the magnesium compound is selected from the group consisting of magnesium sulfate, magnesium nitrate and magnesium oxide.

5. The composition according to claim 4, the vanadium compound is selected from the group consisting of vanadium pentoxide ($V_2O_5$), vanadium trioxide ($V_2O_3$), vanadium dioxide ($VO_2$), vanadium oxyacetylacetonate, vanadium acetylacetonate, vanadium trichloride ($VCl_3$), vanadium monoxide (VO), and ammonium metavanadate ($NH_4VO_3$).

6. The composition according to claim 1, wherein a zirconium or titanium compound is used as the crosslinking accelerating and coupling agent.

7. The composition according to claim 6, wherein the titanium compound is at least one titanium compound selected from the group consisting of diisopropyl ditri-ethanolamino titanate, titanium lactate chelate and titanium acetylacetonate.

8. The composition according to claim 1, wherein the antifoaming agent is N-methylethanolamine.

9. The composition according to claim 1, wherein the wetting agent is isopropyl alcohol.

10. The composition according to claim 1, wherein the pH of the composition is within the range of 3 to 7.

11. A steel sheet which is coated with a chromium-free, low-temperature curable, metal-surface treatment composition of claim 1.

12. The steel sheet according to claim 11, wherein a coating temperature of the metal-surface treatment composition is within a range of 30 to 250° C.

13. The steel sheet according to claim 11, wherein a coating amount of a dry film of the metal-surface treatment composition is in a range of 0.05 to 1.0 $g/m^2$.

* * * * *

UNITED STATES PATENT AND TRADEMARK OFFICE

CERTIFICATE OF CORRECTION

PATENT NO. : 7,989,075 B2
APPLICATION NO. : 11/993096
DATED : August 2, 2011
INVENTOR(S) : Jin-Tae Kim It is certified that error appears in the above-identified patent and that said Letters Patent is hereby corrected as shown below:

Column 1, Line 6, delete “nation” and insert -- national --

Column 1, Line 7, delete “KP2006” and insert -- KR2006 --

Signed and Sealed this
Twentieth Day of December, 2011

David J. Kappos

David J. Kappos
*Director of the United States Patent and Trademark Office*